US006240825B1

(12) United States Patent
Xie

(10) Patent No.: US 6,240,825 B1
(45) Date of Patent: Jun. 5, 2001

(54) GUIDE BAR GUIDE ASSEMBLY AND ASSOCIATED BAND SAW APPARATUS

(75) Inventor: Mark Xie, Tipp City, OH (US)

(73) Assignee: Premark FEG L.L.C., Wilmington, DE (US)

( * ) Notice: Subject to any disclaimer, the term of this patent is extended or adjusted under 35 U.S.C. 154(b) by 0 days.

(21) Appl. No.: 09/427,648

(22) Filed: Oct. 27, 1999

Related U.S. Application Data

(63) Continuation-in-part of application No. 09/141,087, filed on Aug. 27, 1998, now Pat. No. 6,047,624.

(51) Int. Cl.[7] ..... B26D 1/54
(52) U.S. Cl. ..... 83/820; 83/546; 83/829
(58) Field of Search ..... 83/813, 814, 827, 83/829, 860, 546, 820

(56) References Cited

U.S. PATENT DOCUMENTS

| | | | | |
|---|---|---|---|---|
| D. 277,822 | | 3/1985 | Doggett . | |
| 403,172 | | 5/1889 | Backer . | |
| 778,991 | | 1/1905 | McDonough . | |
| 799,150 | | 1/1905 | Dittbenner . | |
| 1,054,288 | | 2/1913 | Fleming . | |
| 1,811,906 | | 6/1931 | Andre . | |
| 1,841,939 | | 1/1932 | Koning et al. . | |
| 1,848,300 | | 3/1932 | Avilla . | |
| 2,059,595 | | 11/1936 | McKeage . | |
| 2,193,946 | | 3/1940 | Tautz . | |
| 2,371,731 | * | 3/1945 | Boice et al. | 83/820 |
| 2,492,824 | | 12/1949 | Ahrndt et al. . | |
| 2,525,004 | | 10/1950 | Spang . | |
| 2,884,026 | | 4/1959 | Krenzke . | |
| 3,104,575 | | 9/1963 | Robinson . | |
| 3,104,688 | * | 9/1963 | Bretthauer | 83/441.1 |
| 3,285,301 | | 11/1966 | McManama . | |
| 3,452,734 | | 7/1969 | Cleland et al. . | |
| 3,680,421 | | 8/1972 | Conner et al. . | |
| 3,682,030 | | 8/1972 | Harris . | |
| 3,888,148 | | 6/1975 | Weissman . | |
| 3,889,564 | | 6/1975 | Aspinwall et al. . | |
| 3,939,749 | | 2/1976 | Muller et al. . | |
| 4,290,330 | | 9/1981 | Washio et al. . | |
| 4,327,621 | | 5/1982 | Voorhees et al. . | |
| 4,640,170 | | 2/1987 | Bakken . | |
| 5,588,213 | | 12/1996 | Swanberg . | |
| 5,802,939 | | 9/1998 | Wiand et al. . | |

OTHER PUBLICATIONS

"*Hobart Catalog of Replacement Parts, Model 5801 Meat Saw*", Hobart Corporation (Oct. 1990).

* cited by examiner

*Primary Examiner*—W. Donald Bray
(74) *Attorney, Agent, or Firm*—Thompson Hine & Flory LLP

(57) ABSTRACT

A guide assembly includes a sleeve-shaped member having first and second ends. At least one insert member is positioned within one of the ends of said sleeve-shaped member, the insert member including an end-to-end channel. A guide bar extends through the sleeve-shaped member and along the end-to-end channel of the insert member. A first end of the guide bar extends from the first end of the sleeve-shaped member and a second end of the guide bar extends from the second end of the sleeve-shaped member. A second insert member positioned in the other end of the sleeve-shaped member may also be provided.

25 Claims, 6 Drawing Sheets

GUIDE BAR GUIDE ASSEMBLY AND ASSOCIATED BAND SAW APPARATUS

CROSS-REFERENCE TO RELATED APPLICATIONS

This application is a continuation-in-part of application Ser. No. 09/141,087, filed Aug. 27, 1998 now U.S. Pat. No. 6,047,624.

FIELD OF THE INVENTION

The present invention relates to band saw guide assemblies and more particularly to a guide assembly for receiving a guide bar of a meat band saw wherein the guide bar is connected to a blade guard such that a position of the blade guard along a length of a band saw blade varies as a position of the guide bar relative to the guide assembly varies.

BACKGROUND OF THE INVENTION

In the food processing industry large upright band saws such as band saw 10 of FIG. 1 are commonly used for cutting meat products of a variety of sizes. Such band saws typically include a frame 12 upon which is mounted a support surface 14 for positioning meat products to be cut. A housing portion 16 extends above support surface 14 and a housing portion 18 extends below support surface 14. A band saw blade 20 passes though a plane defined by support surface 14 and extends around wheel members (not shown) located with housing portions 16 and 18 for being drivingly rotated by such wheel members. In particular, a drive motor 22 may be connected for rotating a drive wheel in housing portion 18. A blade guard 24 extends around the cutting edge of blade 20 and downward from housing portion 16 toward support surface 14. Blade guard 24 is connected to a guide bar 26 which extends upward toward housing portion 16 and through a guide assembly 28 which is mounted to housing portion 16. Guide bar 26 is slidably positioned within guide assembly 28 such that guide bar 26 can be moved upward or downward through such guide assembly if a sufficient moving force is applied thereto. However, with no moving force applied guide assembly 28 engages guide bar 26 with sufficient force to hold guide bar 26 and blade guard 24 in position. Because blade guard 24 is connected to guide bar 26 for movement therewith, the length of band saw blade 20 which is protected by the blade guard 24 can be varied by varying the position of guide bar 26 relative to guide assembly 28.

Referring to FIG. 2, an exploded perspective view of a prior art guide assembly 28 is shown relative to guide bar 26 and blade guard 24. Such guide assembly 28 includes a support member 30, a retaining plate 32, a brake shoe 34, a spring 36, a screw carrier 38, a screw 40 and an end cap 42. Support member 30 may be mounted to housing portion 16 by a bracket assembly 44 (shown in shadow) for example. Support member 30 includes channels 46, 48 through which guide bar 26 passes, with an open face 50 of support member 30 exposing a surface of guide bar 26. When assembled, retaining plate 32 is mounted to support member 30 by a plurality of screws (not shown), plate 32 including an opening 52 therethrough which extends to open face 50 of support member 30. Brake shoe 34, spring 36, screw carrier 38 and screw 40 are positioned withing opening 52 such that spring 36 urges brake shoe 34 into frictional contact with guide bar 26 to support guide bar 26 until the frictional force is overcome. As shown, blade guard 24 may be mounted to the bottom of guide bar 26 by a threaded handle 54.

Although effective, prior art guide assembly 28 is somewhat costly due to the machining requirements of support member 32. Accordingly, it is desirable and advantageous to provide a guide assembly which is relatively simple and inexpensive.

SUMMARY OF THE INVENTION

In one aspect of the present invention, a guide assembly for receiving a guide bar of a band saw is provided. The guide assembly includes a sleeve-shaped member having first and second ends. An insert member is positioned within one of the ends of the sleeve-shaped member such that an end-to-end opening of the insert member forms a first guide bar receiving channel.

The guide bar may be slidably positioned through the guide bar receiving channel. The use of a sleeve-shaped member and insert member eliminates the costly machining associated with the prior art, particularly where the insert member is formed of a plastic material. Further, preferably the insert member includes an exposed end having a peripheral lip which overlaps the end of the sleeve-shaped member. The peripheral lip facilitates proper positioning of the insert member in the end of the sleeve-shaped member, and advantageously prevents food product from entering between the outer surfaces of the insert members and the inner surfaces of the end of the sleeve-shaped member. Two insert members are preferably provided, one in each end of the sleeve-shaped member.

In another aspect of the invention, a guide assembly includes a sleeve-shaped member having first and second ends. At least one insert member is positioned within one of the ends of said sleeve-shaped member, the insert member including an end-to-end channel. A guide bar extends through the sleeve-shaped member and along the end-to-end channel of the insert member. A first end of the guide bar extends from the first end of the sleeve-shaped member and a second end of the guide bar extends from the second end of the sleeve-shaped member.

DETAILED DESCRIPTION OF THE EMBODIMENTS

Figure 3:
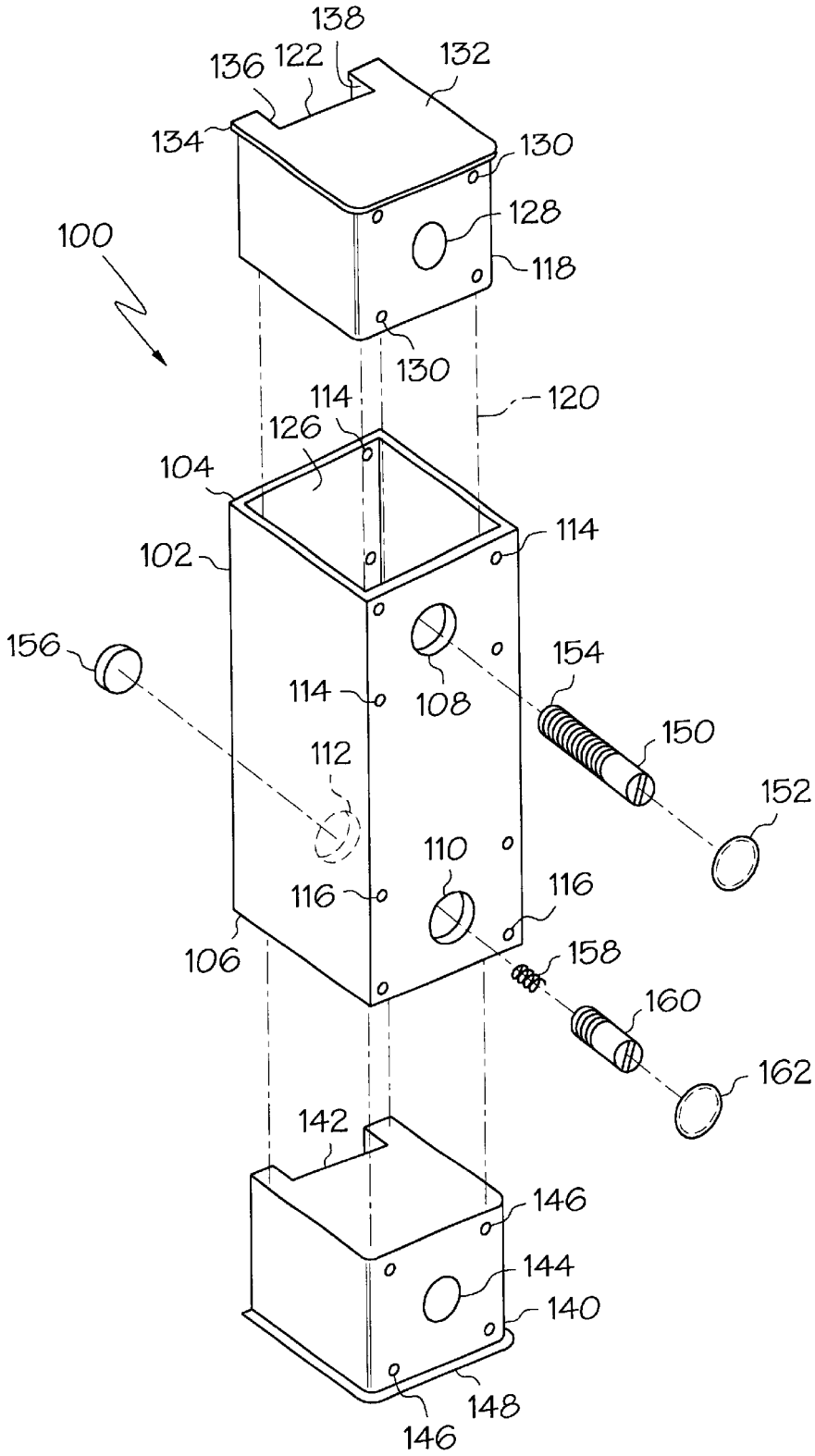
FIG. 3 is an exploded perspective view of one embodiment of a guide assembly.

Referring to drawing FIG. 3, numeral 100 depicts an exploded view of a guide assembly in accordance with the present invention, such guide assembly 100 including a sleeve-shaped member 102 having open ends 104 and 106. Sleeve-shaped member 102 is preferably formed of a suitable metal and may advantageously be formed from a standard stock square tubing cut to length. Sleeve-shaped member 102 includes an opening 108 along a side portion thereof near end 104 and exposing the interior thereof. A similar opening 110 along a side portion thereof near end 106 exposes the interior thereof, and an opening 112 is aligned opposite opening 110. A plurality of smaller holes 114, 116 are provided in the region of each of openings 108, 110.

A block-shaped insert member 118 is configured to be positioned within end 104 sleeve-shaped member 102 as indicated by arrow 120. When so positioned, an outer peripheral surface portion 122 of insert member 118 forms a guide bar receiving channel 124 (FIG. 4) with an inner peripheral surface portion 126 of end 104 of sleeve-shaped member 102. In the preferred embodiment surface portion 122 is formed by an end-to-end recess formed in a side of insert member 118. Insert member 118 includes a through hole 128 and a plurality of smaller through holes 130 positioned such that when insert member 118 is inserted within end 104 of sleeve-shaped member 102 hole 128 aligns with hole 108, and holes 130 align with respective holes 114 for attachment purposes as described in greater detail below. Insert member 118 further includes an end 132 having an outer peripheral lip 134 extending beyond the sides thereof from a first side 134 of recess 122, around insert member 118, to a second side 138 of recess 122. When inserted, peripheral lip 134 contacts an end surface of end 104 to properly position insert member 118 and to provide sealing contact with end 104.

A similar insert member 140 is configured for positioning within end 106 of sleeve-shaped member 102 and includes an outer peripheral surface portion 142 formed by an end to end recess such that when inserted in end 106 a guide bar receiving channel is formed in alignment with the guide bar receiving channel 124 formed by insert member 118. Further, insert member 140 includes a through hole 144 and a plurality of smaller holes 146 configured for alignment with sleeve-shaped member opening 110 and holes 116 respectively. An outer peripheral lip 148 is also provided on the exposed end of insert member 140.

In the preferred assembly, insert member 118 and insert member 140 may be formed identically to reduce manufacturing costs. Further, insert members 118, 140 may be formed from a high density polymeric material such as CELCON.

Also shown in the exploded view of FIG. 3 is a threaded member 150 for positioning through opening 108 of sleeve-shaped member 102 and hole 128 of insert member 118. In this regard, an internal portion of through hole 128 is threaded for receiving threaded member 150, which may for example be a set screw. An outer cap member 152 is configured for being fixed to opening 108 for covering the same. Threaded member 150 may be formed of any suitable material although end 154 of threaded member 150 will engage a surface of a guide bar inserted through assembly 100 and therefore at least such end 154 should be formed of a material such as plastic.

A brake shoe 156, a biasing member 158, a threaded member 160, and cap member 162 are likewise configured for positioning near end 106, with brake shoe 156 insertable through opening 112 and biasing member 158 and threaded member 160 insertable through opening 110 and hole 144. In this regard, as with hole 128, hole 144 of insert member 140 includes an inner threaded portion for receiving threaded member 160. Brake shoe 156 may be formed of a suitable rubber material for slidingly engaging a guide bar inserted into assembly 100. Biasing member 158 may be a compression spring but may likewise be any other suitable member which tends to exert a force when compressed, and threaded member 160 may likewise be formed of metal, plastic, or other material.

Figure 4:
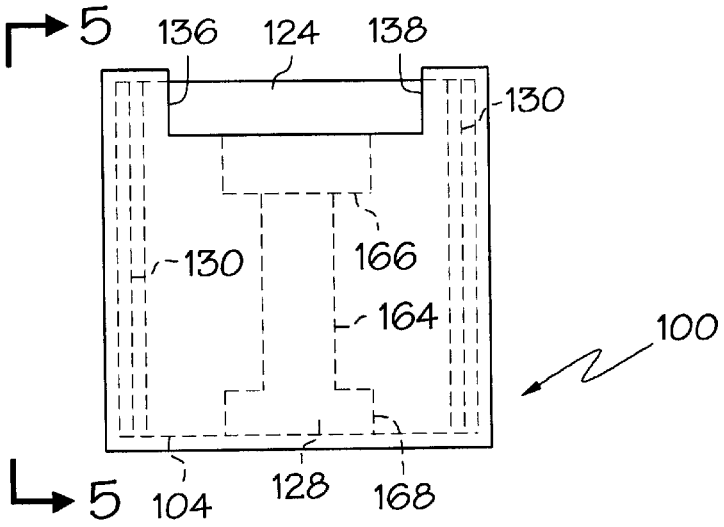
FIG. 4 is a top assembled view of the guide assembly of FIG. 3.

Referring now to FIG. 4 wherein a top view of guide assembly 100 is shown with insert members 118, 140 positioned within sleeve-shaped member 102, outer peripheral lip 134, 148 extends flush with an outer surface of ends 104, 106 of sleeve-shaped member 102 from side 136 of channel 124 to side 138 of channel 124. An inner threaded portion 164 of through hole 128, 144 is shown in shadow along with an open portion 166 in which brake shoe 156 may positioned for being biased into engagement with the guide bar. An open portion 168 of through hole 128, 144 in which an inner portion of respective cap member 152, 162 may be seated is also provided in each insert member 118, 140. Holes 130, 146 are also shown in shadow.

Figure 5:
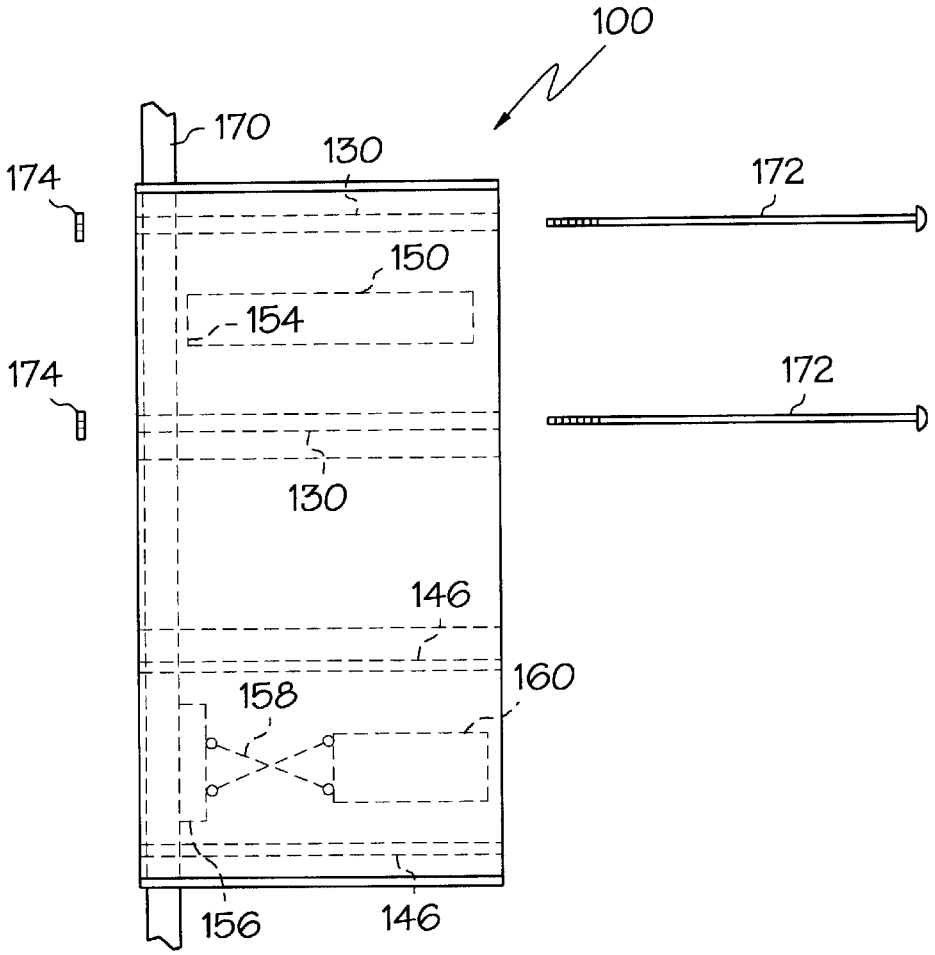
FIG. 5 is a side elevation view along line 5—5 of FIG. 4, including a guide bar inserted within the guide assembly.

As seen in the side elevation view of FIG. 5, a guide bar 170 may be positioned within guide assembly 100. Attachment bolts 172 and mating nuts 174 may be positioned through holes 130 for securing insert member 118 within sleeve-shaped member 100. Similar attachment bolts and nuts (not shown) may be used to secure insert member 140 within sleeve-shaped member 102 utilizing through holes 146. In operation threaded member 150 is tightened until the interior end 154 contacts the surface of guide bar 170 to prevent lateral (left-to right in FIG. 5) movement of guide bar 170. Threaded member 160 is tightened until its interior end engages biasing member 158, compressing biasing member 158 such that a force is exerted on brake pad 156 causing a brake surface of brake pad 156 to contact a surface of guide bar 170. Brake pad 156 engages guide bar 170 with sufficient force to hold guide bar 170 from moving in the downward direction unless an external force is applied to guide bar 170 to cause such movement. The external force required for upward or downward movement of guide bar 170 can be adjusted by adjusting the compression of biasing member 158 with threaded member 160.

Figure 6:
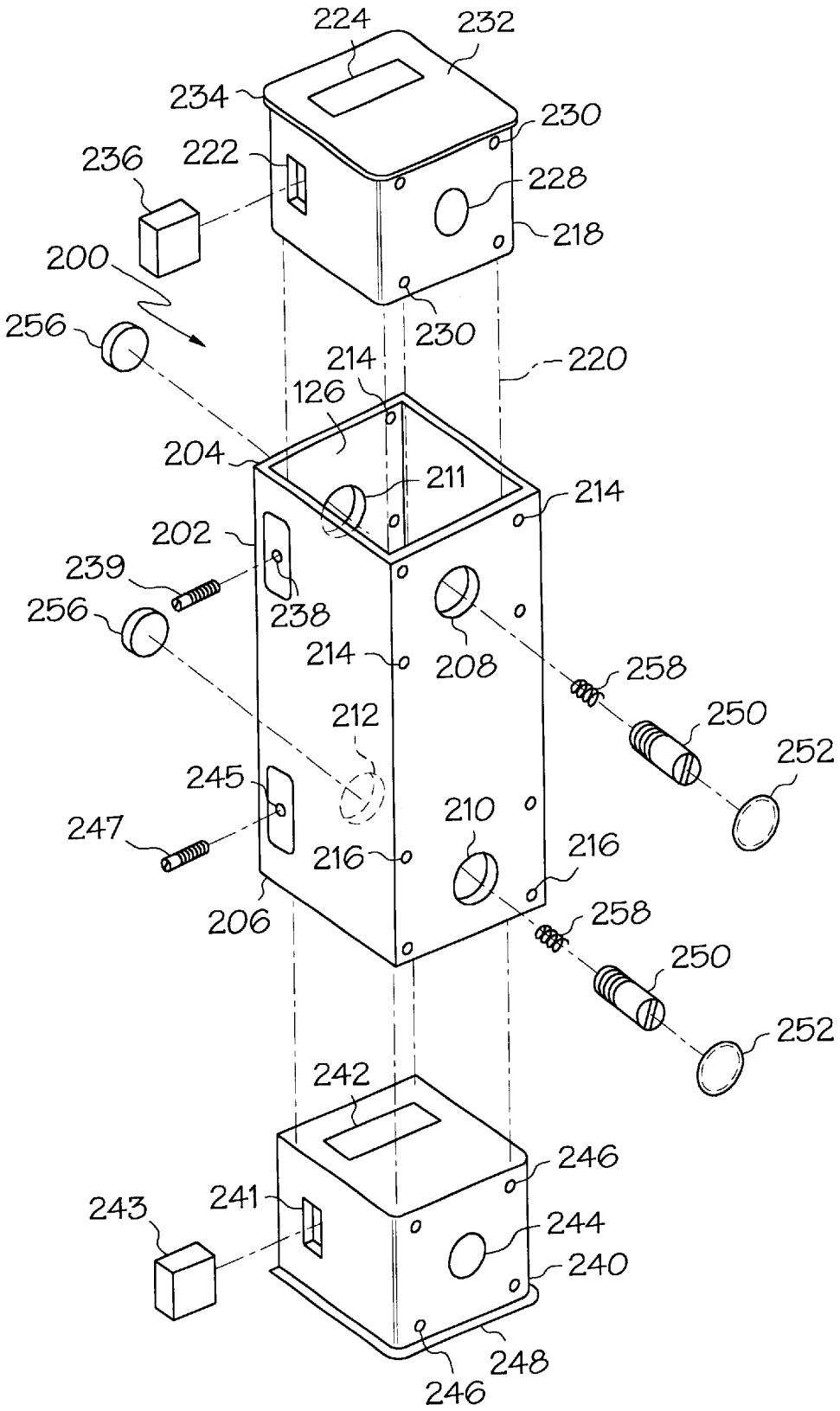
FIG. 6 is an exploded perspective view of another embodiment of a guide assembly.

Referring to drawing FIG. 6, an alternative construction 200 is shown in exploded view. Guide assembly 200 includes a sleeve-shaped member 202 having open ends 204 and 206. Sleeve-shaped member 202 includes an opening 208 along a side portion thereof near end 204 and exposing the interior thereof. A similar opening 210 is located along a side portion thereof near end 206. An opening 212 is aligned opposite opening 210 and an opening 211 is aligned opposite opening 208. A plurality of smaller holes 214, 216 are provided in the region of each of openings 208, 210.

A block-shaped insert member 218 is configured to be positioned within end 204 of sleeve-shaped member 202 as indicated by line 220. When so positioned, an end-to-end opening through insert member 218 forms a guide bar receiving channel 224. Insert member 218 includes a hole 228 and a plurality of smaller through holes 230 positioned such that when insert member 218 is positioned within end 204 of sleeve-shaped member 202 hole 228 aligns with hole 208, and holes 230 align with respective holes 214 for attachment purposes as described in greater detail below. Insert member 218 further includes an end 232 having an outer peripheral lip 234 extending beyond the sides of the insert member. When inserted, peripheral surface 234 contacts an end surface of end 204 to properly position insert member 218 and to provide sealing contact with end 204, and is preferably flush with the outer surface of the end of the sleeve-shaped member. Insert member 218 also includes a lateral passage 222 which extends to the guide bar receiving channel 224 and receives a guide block 236. A weld nut 238 is provided on the exterior of the sleeve-shaped member for receiving a set screw 239 which can be used to push the guide block into the passage 222. For ease of manufacture, the lateral passage may extend from one side of the insert member to the other, through the guide bar receiving channel.

A similar insert member 240 is configured for positioning within end 206 of sleeve-shaped member 202 and includes an end-to-end opening which forms a guide bar receiving channel 242 in alignment with the guide bar receiving channel 224 formed by insert member 218. Further, insert member 240 includes a hole 244 and a plurality of smaller holes 246 configured for alignment with sleeve-shaped member opening 210 and holes 216 respectively. An outer peripheral lip 248 is also provided on the exposed end of insert member 240. A passage 241, guide block 243, weld nut 245 and set screw 247 are also provided for insert member 240.

Also shown in the exploded view of FIG. 6 are like threaded members 250 for positioning through openings 208, 210 of sleeve-shaped member 202 and holes 228, 244 of insert members 218, 240. In this regard, an internal portion of through holes 228, 244 is threaded for receiving threaded member 250, which may for example be a set screw. An outer cap member 252 is configured for being fixed to openings 208, 210 for covering the same. Brake shoes 256 and biasing members 258 are also provided, the brake shoes 156 insertable through openings 212, 211.

Figure 7:
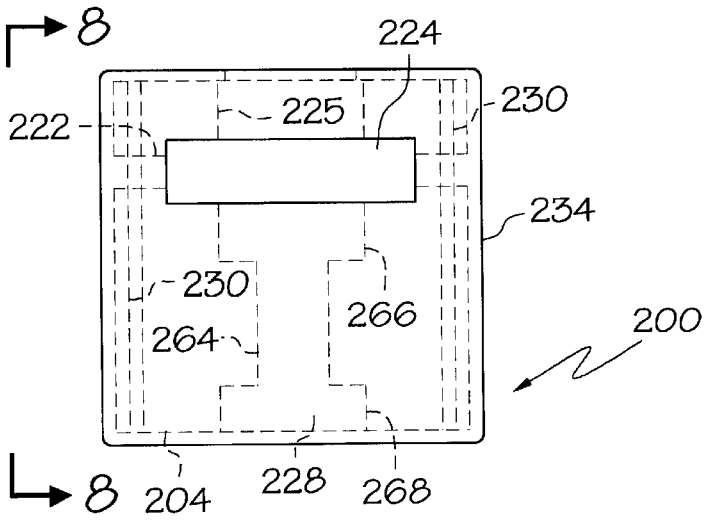
FIG. 7 is a top assembled view of the guide assembly of FIG. 6.
Figure 8:
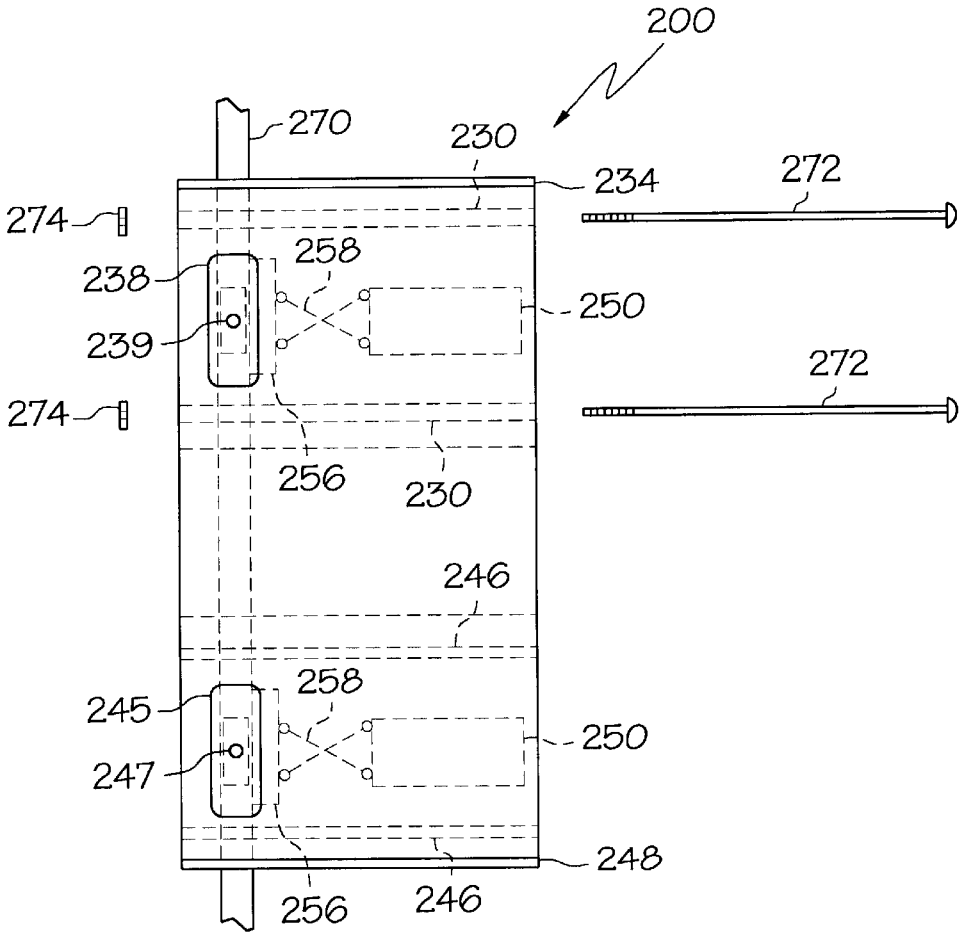
FIG. 8 is a side elevation view along line 8—8 of FIG. 7.

Referring now to FIGS. 7 and 8, outer peripheral lips 234, 248 extend flush with the outer surface of the ends 204, 206 of sleeve-shaped member 202. An inner threaded portion 264 of each through hole 228, 244 is shown in shadow along with an open portion 266 in which brake shoes 256 may positioned for being biased into engagement with the guide bar 270. A rear opening 255 is provided for inserting the brake shoes within open portions 266 after the insert members have been positioned in the ends of sleeve-shaped member 202. An open portion 268 of through holes 228, 244 in which an inner portion of respective cap members 252 may be seated is also provided. Holes 230, 246 are also shown in shadow. Similarly, lateral passage 222 is shown in shadow.

As seen in the side elevation view of FIG. 8, a guide bar 270 may be positioned within guide assembly 200. Attachment bolts 272 and mating nuts 274 may be positioned through holes 230 for securing insert member 218 within sleeve-shaped member 200. Similar attachment bolts and nuts (not shown) may be used to secure insert member 240 within sleeve-shaped member 202 utilizing through holes 246. Each threaded member 250 is tightened until its interior end engages corresponding biasing member 258, compressing biasing member 258 such that a force is exerted on brake pad 256 causing a brake surface of brake pad 256 to contact a surface of guide bar 270. Brake pads 256 engage guide bar 270 with sufficient force to hold guide bar 270 from moving in the downward direction unless an external force is applied to guide bar 270 to cause such movement. The external force required for upward or downward movement of guide bar 270 can be adjusted by adjusting the compression of biasing members 258 with threaded members 250.

Guide blocks 236 and 243 of guide assembly 200 are positioned within passages 222 and 241 before the insert members 218 and 240 are placed in the ends of the sleeve-shaped member 202. Once the insert members are properly positioned, set screws 239 and 247 can be adjusted to push an inner surface of the guide blocks 236 and 243 against the guide bar 270 to prevent lateral movement of the guide bar 270.

Guide assembly 200 provides end-to-end openings through its insert members as opposed to the end-to-end slots on a side portion thereof as in guide assembly 100. By forming the guide bar receiving channels with such end-to-end openings the guide bar does not contact the sleeve-shaped member, reducing noise which can be produced by sliding contact between the guide bar and the sleeve-shaped member. Further, although guide assembly 100 is shown without with the lateral passages and guide blocks of guide assembly 200, it is recognized that guide assembly 100 could include such features.

Figure 1:
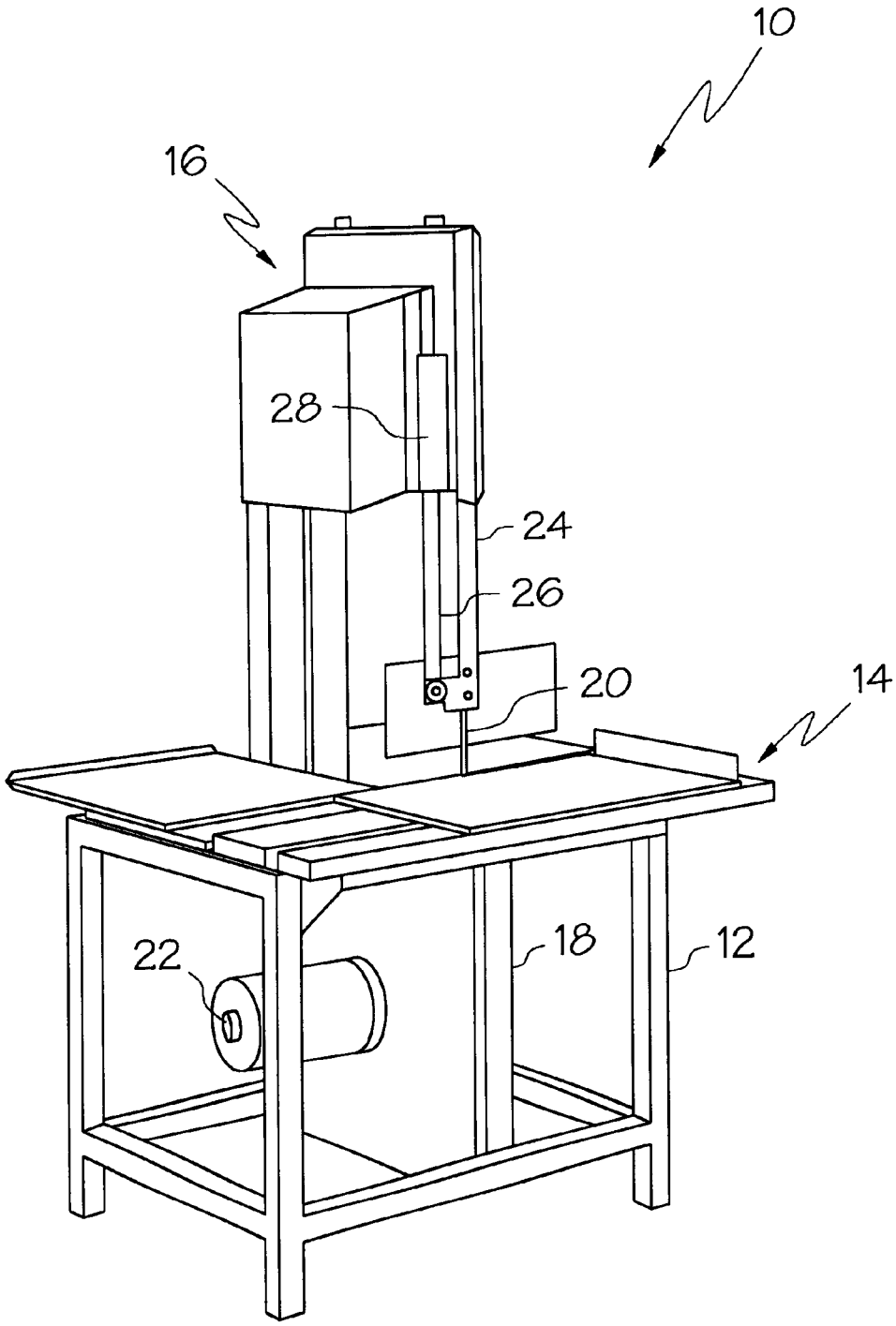
FIG. 1 PRIOR ART
FIG. 1 is a perspective view of a band saw apparatus.
Figure 2:
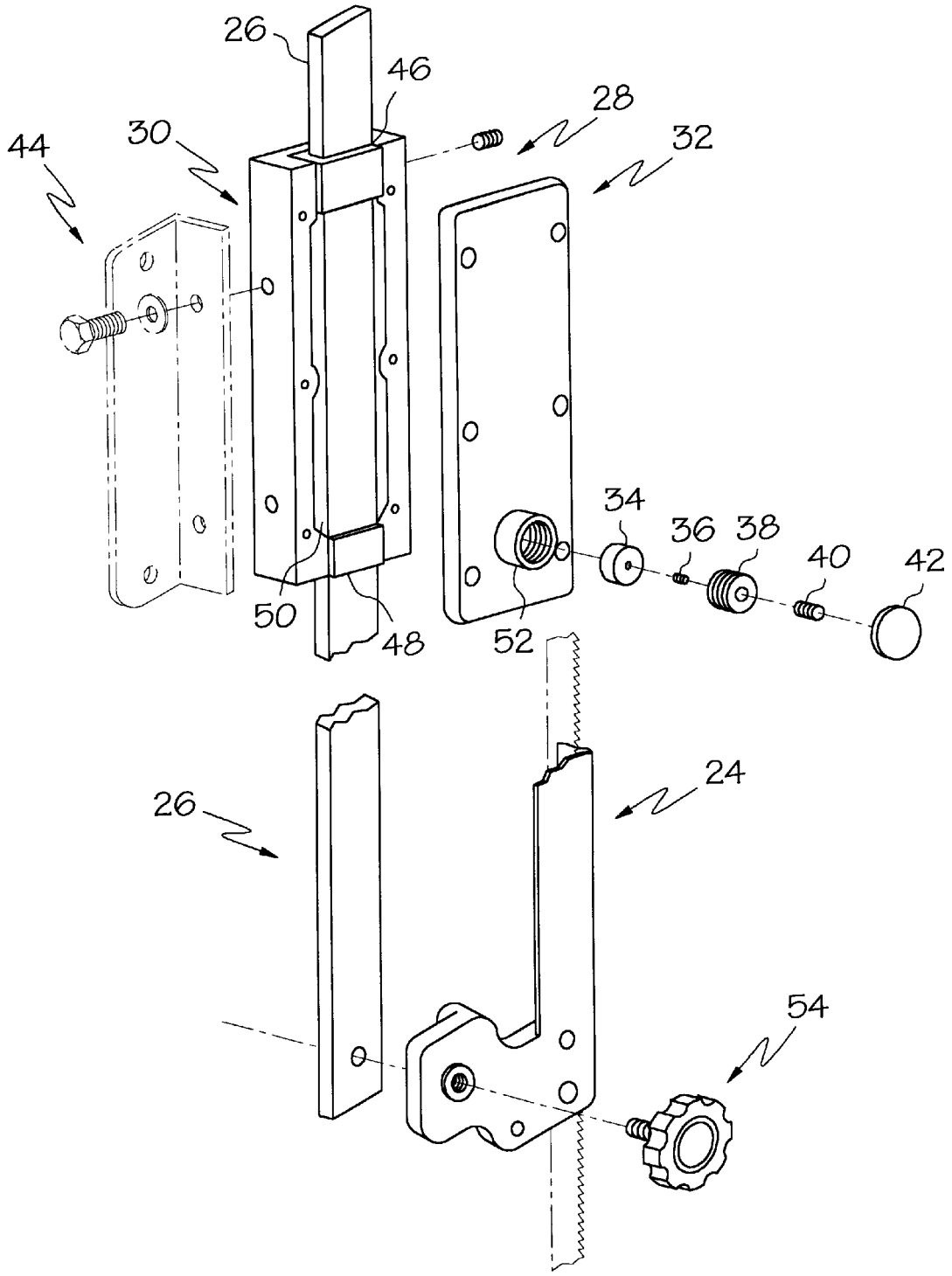
FIG. 2 PRIOR ART
FIG. 2 is an exploded perspective view of a prior art guide assembly and associated guide bar and blade guard.

Guide assemblies 100 and 200 can be positioned in a band saw apparatus such as that shown in FIG. 1 with a blade guard 24 connected for movement with guide bar 170. Such attachment to a band saw apparatus may be by a bracket assembly as shown in FIG. 2 but advantageously may also be achieved by using the same bolt and nut assemblies used to secure the insert members in position. The use of sleeve-shaped member with insert members eliminates the costly machining associated with the prior art. Further, the peripheral lip of each insert member which overlaps the sleeve-shaped members end to facilitate proper positioning of the insert members and advantageously prevents food product from entering between the outer surfaces of insert members and the inner surfaces of the ends of the sleeve-shaped members.

Although the invention has been described and illustrated in detail it is to be clearly understood that the same is intended by way of illustration and example only and is not intended to be taken by way of limitation. For example, although sleeve-shaped member is shown as an elongated square tube it is recognized that sleeve-shaped member could take some other shape with the insert members being similarly shaped for insertion therein. Accordingly, the spirit and scope of the invention are to be limited only by the terms of the appended claims.

What is claimed is:

1. A guide assembly for receiving a guide bar of a band saw, the guide assembly comprising:

a sleeve-shaped member having first and second open ends;

a first insert member positioned within said first open end of said sleeve-shaped member, said first insert member having an end-to-end opening forming a first guide bar receiving channel; and a second insert member positioned within said second open end of said sleeve-shaped member, said second insert member having an end-to-end opening forming a second guide bar receiving channel, said second guide bar receiving channel being substantially aligned with said first guide bar receiving channel.

2. The guide assembly of claim 1 wherein said sleeve-shaped member includes a first opening along a side portion thereof, said first opening exposing a side portion of said first insert member, said first insert member including a hole which extends from said side portion to said first guide bar receiving channel.

3. The guide assembly of claim 2 wherein at least a portion of said hole of said first insert member is threaded, the guide assembly further comprising a first threaded member, a first biasing member, and a first brake shoe, said threaded member threaded within said hole of said first insert member, said first biasing member including a first side for positioning adjacent an internal end of said first threaded member and a second side for positioning adjacent said first brake shoe, said first brake shoe including a brake surface for engaging a surface of the guide bar when the guide bar is positioned within said first guide bar receiving channel.

4. The guide assembly of claim 3 wherein said sleeve-shaped member includes a second opening along a side portion thereof, said second opening exposing a side portion of said second insert member, said second insert member including a hole which extends from said side portion to said second guide bar receiving channel, at least a portion of said hole of said second insert member being threaded, the guide assembly further comprising a second threaded member threaded within said hole of said second insert member, a second brake shoe positioned adjacent said second guide bar receiving channel, and a second biasing member positioned between said second threaded member and said second brake shoe.

5. The guide assembly of claim 1 wherein an exposed end of said first insert member includes a peripheral lip which contacts said first open end of said sleeve-shaped member around an entirety of said first open end and wherein said exposed end of second insert member includes a peripheral lip which contacts said second open end of said sleeve-shaped member around an entirety of said second open end.

6. The guide assembly of claim 1 wherein each of said first and second insert members is secured within its respective open end by at least one respective threaded member.

7. The guide assembly of claim 1 wherein said sleeve-shaped member is substantially rectangular in cross-section along its length and each of said first and second insert members is substantially block-shaped.

8. The guide assembly of claim 1 wherein said sleeve-shaped member is formed from a metal material and wherein each of said first and second insert members is formed of a plastic material.

9. The guide assembly of claim 1 wherein said guide bar receiving channels have a rectangular shape when viewed from end-to-end and said guide assembly further includes a brake shoe positioned within a hole in said first insert member and having a surface adjacent a first side of said first guide bar receiving channel, and a guide block positioned within a passage of said first insert member, a side portion of said guide block positioned adjacent a second side of said first guide bar receiving channel, said first side being substantially perpendicular to said second side.

10. A band saw apparatus for cutting meat or the like comprising:

a support surface for positioning an item to be cut thereon;

a housing portion extending above said support surface;

a blade extending through a plane defined by said support surface;

a guide assembly including a sleeve-shaped member mounted to said frame and having first and second ends, a first insert member positioned within said first end such that an end-to-end opening through said first insert member forms a first channel, a second insert member positioned within said second end such that an end-to-end opening of said second insert member forms a second channel, wherein said second channel is substantially aligned with said first channel;

a guide bar extending through said first and second channels of said guide assembly toward said support surface; and a blade guard connected to said guide bar for movement therewith.

11. The band saw apparatus of claim 10 wherein said guide assembly includes at least one brake shoe having a brake surface engaging a surface of said guide bar, said brake shoe positioned within a hole of said first insert member and being biased into engagement with said guide bar by a biasing member.

12. The band saw apparatus of claim 11 wherein said sleeve-shaped member of said guide assembly includes a first opening along a side portion thereof and adjacent a side portion of said first insert member, said hole of said first insert member extending from said first opening of said sleeve-shaped member toward said biasing member and said brake shoe, a threaded member threaded into said hole such that an end thereof engages said biasing member for providing adjustment of a biasing force of said biasing member.

13. The band saw apparatus of claim 10 wherein said first insert member includes an exposed end having a peripheral lip positioned adjacent said first end of said sleeve-shaped member, and wherein said second insert member includes an exposed end having a peripheral lip positioned adjacent said second end of said sleeve-shaped member.

14. The band saw apparatus of claim 9 wherein said sleeve-shaped member is substantially rectangular in cross-section along its length and each of said first and second insert members is substantially block-shaped.

15. A guide assembly for receiving a guide bar of a band saw, comprising:

a sleeve-shaped member having first and second ends;

at least one insert member positioned within said sleeve-shaped member, an end-to-end opening of said insert member forming a guide bar receiving channel, said insert member including at least one exposed end having a peripheral lip positioned adjacent one of said ends of said sleeve-shaped member.

16. The guide assembly of claim 15 wherein said guide assembly further includes a brake pad and a biasing member, said brake pad positioned with a brake surface thereof adjacent said guide bar receiving channel, said biasing member biasing said brake pad toward said guide bar receiving channel.

17. The guide assembly of claim 15 wherein said insert member includes a passage which extends from a side of said insert member toward said guide bar receiving channel, a guide block positioned within said passage, a threaded member extending through said sleeve-shaped member and having an end which contacts said guide block for holding said guide block in position.

18. The guide assembly of claim 15 wherein said insert member is formed from a high density polymeric material, and an outer edge of said peripheral lip is flush with an other surface of said sleeve-shaped member.

19. A guide assembly, comprising:

a sleeve-shaped member having first and second ends;

at least one insert member positioned within one of said ends of said sleeve-shaped member, said insert member including an end-to-end channel; and a guide bar extending through said sleeve-shaped member and along said end-to-end channel of said insert member, a first end of said guide bar extending from said first end of said sleeve-shaped member and a second end of said guide bar extending from said second end of said sleeve-shaped member.

20. The guide assembly of claim 19 wherein said sleeve-shaped member is substantially rectangular in cross-section along its length.

21. The guide assembly of claim 19 wherein said end-to-end channel is formed by a recess in a side portion of said insert member.

22. The guide assembly of claim 19 wherein said end-to-end channel is formed by an end-to-end opening through said insert member.

23. The guide assembly of claim 19 wherein said sleeve-shaped member includes an opening along a side portion thereof, said insert member including a hole which extends from said opening of said sleeve-shaped member to said channel, at least a portion of said hole being threaded, a brake shoe positioned within said hole adjacent said channel for contacting said guide bar, a threaded member threaded into said hole, and a biasing member positioned between said brake shoe and said threaded member.

24. The guide assembly of claim 19 further comprising a guide block, said insert member including a passage which extends to said channel, said guide block positioned within said passage and having a side surface for contacting a side portion of said guide bar.

25. The guide assembly of claim 24 further comprising a threaded member extending through said sleeve-shaped member and having an end which contacts said guide block for holding said guide block in position.

* * * * *